US007950308B2

(12) United States Patent
Atsumi et al.

(10) Patent No.: US 7,950,308 B2
(45) Date of Patent: May 31, 2011

(54) HAMMER FOR BREAKING POLYCRYSTALLINE SILICON

(75) Inventors: Tetsuya Atsumi, Suzuka (JP); Munehiro Takasugi, Saitama (JP)

(73) Assignee: Mitsubishi Materials Corporation, Tokyo (JP)

( * ) Notice: Subject to any disclaimer, the term of this patent is extended or adjusted under 35 U.S.C. 154(b) by 235 days.

(21) Appl. No.: 12/230,140

(22) Filed: Aug. 25, 2008

(65) Prior Publication Data

US 2009/0056504 A1 Mar. 5, 2009

(30) Foreign Application Priority Data

Aug. 27, 2007 (JP) ..... 2007-220220
Jun. 30, 2008 (JP) ..... 2008-170700

(51) Int. Cl.
*B25D 1/14* (2006.01)

(52) U.S. Cl. ..... 81/26; 81/20

(58) Field of Classification Search ..... 81/20, 26; D8/75, 77

See application file for complete search history.

(56) References Cited

U.S. PATENT DOCUMENTS 207,671 A * 9/1878 Morrill ..... 403/257
855,079 A * 5/1907 Ward ..... 81/20
974,021 A * 10/1910 Blake ..... 81/25
D161,810 S * 2/1951 Alexander ..... D8/75
2,781,805 A * 2/1957 Freeman ..... 81/22
2,967,738 A * 1/1961 Moore ..... 403/248
3,115,912 A * 12/1963 Harris ..... 81/20
3,341,261 A * 9/1967 Fenlin ..... 403/249
3,640,324 A * 2/1972 Porter ..... 81/20
3,712,284 A * 1/1973 Porter ..... 125/40
3,792,725 A * 2/1974 Burgeson ..... 81/20
4,016,640 A * 4/1977 Briggs ..... 29/450
4,172,483 A * 10/1979 Bereskin ..... 81/20
4,225,072 A * 9/1980 Reeves ..... 225/104
4,242,780 A * 1/1981 Littman ..... 29/81.17
4,383,073 A * 5/1983 Wessling et al. ..... 525/486
4,633,741 A * 1/1987 Yang ..... 81/20
D366,604 S * 1/1996 Welch, Jr. ..... D8/77
6,347,562 B1 * 2/2002 Gerber, Jr. ..... 81/25

(Continued)

FOREIGN PATENT DOCUMENTS

DE 298 05 252 6/1998

(Continued)

OTHER PUBLICATIONS

European Search Report dated Mar. 27, 2009, issued on the corresponding European patent application No. 08 16 2995.8.

*Primary Examiner* — David B Thomas

(74) *Attorney, Agent, or Firm* — Edwards Angell Palmer & Dodge LLP

(57) ABSTRACT

The hammer for breaking polycrystalline silicon is provided with a handle portion extending along a center axis and a head portion extending in a direction intersecting a direction of the center axis at the leading end of the handle portion. The head portion is provided with a head main body connecting with the handle portion, a striking part installed at one end of the head main body via a coupling shaft portion, and a counter weight portion installed at the other end of the head main body. The head main body, the coupling shaft portion, the striking part and the counter weight portion are formed integrally from a hard metal. A round-raised striking surface is formed at the striking part.

6 Claims, 4 Drawing Sheets

U.S. PATENT DOCUMENTS

| | | | | |
|---|---|---|---|---|
| 6,755,096 | B2 * | 6/2004 | Schroder | 81/20 |
| D566,509 | S * | 4/2008 | Vanderbeek | D8/75 |
| 2004/0074342 | A1 * | 4/2004 | Pace et al. | 81/20 |
| 2006/0021473 | A1 * | 2/2006 | Deros et al. | 81/20 |

FOREIGN PATENT DOCUMENTS

| | | |
|---|---|---|
| EP | 0539097 | 4/1993 |
| JP | 06-218677 | 8/1994 |
| JP | 10-006242 | 1/1998 |

* cited by examiner

HAMMER FOR BREAKING POLYCRYSTALLINE SILICON

CROSS-REFERENCES TO RELATED APPLICATIONS

This application claims the right of priority to the Japanese Patent Application No. 2007-220220 filed on Aug. 27, 2007 and the Japanese Patent Application No. 2008-170700 filed on Jun. 30, 2008, the contents of which are incorporated herein by reference.

BACKGROUND OF THE INVENTION

1. Field of the Invention

The present invention relates to a hammer used in breaking polycrystalline silicon, which is used as a material for semiconductor-grade silicon, into appropriately sized pieces.

2. Background Art

Materials for wafers of single crystal silicon for semiconductors include, for example, polycrystalline silicon of extremely high purity greater than 99.999999999%. Single crystal silicon is produced by melting polycrystalline silicon of high purity in a crucible to grow single crystal silicon with a seed crystal of single crystal silicon. In the case of manufacturing single crystal silicon, the purity of lumps of polycrystalline silicon used as a material is critically important. Since single crystal silicon is contaminated with impurities during manufacturing processes to result in a large deterioration in the quality of single crystal silicon, it is necessary to prevent the contamination of polycrystalline silicon with the impurities as much as possible.

In the Siemens method, polycrystalline silicon of high purity is manufactured by the procedures in which trichlorosilane ($SiHCl_3$) gas and hydrogen gas are supplied to a reaction furnace in which a silicon seed is arranged and high-purity polycrystalline silicon deposits on the silicon seed. According to this method, an ingot of polycrystalline silicon having a diameter of about 140 mm and formed substantially in a columnar shape is obtained.

The ingot of polycrystalline silicon breaks by being struck with a hammer, and thereby lumps of polycrystalline silicon can be obtained. Each of the lumps of polycrystalline silicon is allowed to be put into the crucible. However, where the striking part of the hammer has a low degree of hardness, the striking surface wears and dust resulting from the wear may be mixed into broken pieces of polycrystalline silicon.

For example, Japanese Unexamined Patent Application, First Publication No. H06-218677, and Japanese Unexamined Patent Application, First Publication No. H10-006242 have disclosed a hammer having a striking part made of a hard metal with a high degree of hardness and less likely to wear by striking, as a hammer used for breaking polycrystalline silicon.

Incidentally, in the hammer disclosed in the above Patent Documents, since the striking surface is made to be relatively flat, polycrystalline silicon may be broken into smaller pieces upon striking. Thus, there is a problem that silicon powder is generated in a greater quantity resulting in a low yield of lumps of polycrystalline silicon. Further, an edge formed at the periphery of the striking surface easily chips causing concern that pieces of the striking part may be mixed with broken pieces of polycrystalline silicon.

Further, since a head main body (made of steel, for example), which is connected to a handle portion, and a striking part (made of tungsten carbide) equipped with a striking surface are formed separately from each other, the striking part may be separated from the head main body on impact. Also, since the head main body is made of a material having a lower degree of hardness than the striking part, the surface bonded with the striking part is liable to wear and metal dust resulting from the wear may be mixed into broken pieces of polycrystalline silicon.

The present invention has been made in view of the above circumstances, an object of which is to provide a hammer capable of suppressing the generation of silicon powder upon breaking of polycrystalline silicon and also preventing pieces of a hammer-constituting member from being mixed into broken pieces of polycrystalline silicon.

SUMMARY OF THE INVENTION

The hammer of the present invention for breaking polycrystalline silicon is provided with a rod-shaped handle portion and a head portion extending in a direction intersecting a center axis of the handle portion at the leading end of the handle portion. The head portion is provided with a head main body connected to the handle portion, a striking part installed at one end of the head main body via a coupling shaft portion, and a counter weight portion installed at the other end of the head main body. The head main body, the coupling shaft portion, the striking part and the counter weight portion are formed integrally from a hard metal. A round-raised striking surface is formed at the striking part.

In the hammer of the present invention for breaking polycrystalline silicon, the striking part is provided with the round-raised striking surface. Thus, when striking an ingot of polycrystalline silicon, the striking surface is in contact with the ingot in a smaller contact area. As a result, the polycrystalline silicon is broken into pieces of suitable size, thus making it possible to prevent the generation of silicon powder. Further, since the striking surface is formed round at the periphery without having an edge, it is possible to prevent the striking part from chipping.

In addition, since the head main body, the coupling shaft portion, the striking part and the counter weight portion are formed integrally from a hard metal, the head portion does not chip upon impact of striking, and thereby preventing the generation of metal powder.

In the hammer of the present invention for breaking polycrystalline silicon, the curvature radius R of the striking surface is preferably in the range of 5 mm to 30 mm.

When the curvature radius R of the striking surface is in the range of 5 mm to 30 mm, the polycrystalline silicon is broken into pieces of suitable size. Thereby, it is possible to suppress the generation of silicon powder which is not usable as a material for wafers of single crystal silicon and improve the productivity.

In the hammer of the present invention for breaking polycrystalline silicon, it is preferable that the striking part is formed in a semi-spherical shape and the coupling shaft portion has a smaller diameter than the striking part formed in a semi-spherical shape. Since the coupling shaft portion having a smaller diameter than the striking part is interposed between the striking part and the head main body, the center of gravity of the hammer is arranged so as to be closer to the striking part than the head main body. Thereby, a greater striking force can be obtained with a smaller force, thus making it possible to break polycrystalline silicon efficiently.

Further, since the striking part is formed in a semi-spherical shape and the striking surface is formed round at the periphery without having an edge, it is possible to reliably prevent the striking part from chipping. Even when the hammer strikes polycrystalline silicon at an inclined angle, the striking surface is reliably in contact with polycrystalline silicon, thus making it possible to break polycrystalline silicon.

In the hammer for breaking polycrystalline silicon of the present invention, when the distance between the center axis of the handle portion to the top of the head of the striking surface is given as L1 and the distance from the center axis to the end face of the counter weight portion is given as L2, it is preferable that the ratio of L1 to L2 be in the range of 1 to 2. Where the ratio of L1 to L2 is in the range of 1 to 2, the center of gravity of the hammer is arranged so as to be closer to the striking part than the head main body. Thereby, a greater striking force can be obtained with a smaller force. Further, since an appropriate distance is retained from the center axis of the handle portion to the top of the head of the striking surface, an operator is not in danger of pounding his/her hand gripping the handle portion against the polycrystalline silicon. Therefore, it is possible to break the polycrystalline silicon easily.

In the hammer of the present invention for breaking polycrystalline silicon, it is preferable that the handle portion be made of wood and a synthetic-resin protective sleeve is fitted at the outside of the handle portion. When the handle portion is made of wood, the hammer is lighter and handled more easily. Further, since the synthetic-resin protective sleeve is fitted at the outside of the handle portion, the handle portion made of wood is not broken on collision of the polycrystalline silicon with the handle portion. Therefore, it is possible to prevent wood chips from being mixed into broken pieces of polycrystalline silicon.

In the hammer of the present invention for breaking polycrystalline silicon, a second striking surface maybe formed at the counter weight portion. It is possible to strike polycrystalline silicon by using not only the striking surface of the striking part but also the second striking surface of the counter weight portion. Thereby, it is possible to selectively use two striking surfaces, depending on the shape of an ingot to be broken and the size of lumps to be obtained, thus making it possible to break polycrystalline silicon efficiently.

According to the hammer of the present invention for breaking polycrystalline silicon, it is possible to suppress the generation of silicon powder upon breaking of polycrystalline silicon. It is also possible to prevent pieces of hammer-constituting members from being mixed into broken pieces of polycrystalline silicon.

PREFERRED EMBODIMENTS

First Embodiment

A hammer 10 of the present embodiment for breaking polycrystalline silicon is used in breaking an ingot of polycrystalline silicon manufactured to be about 140 mm in diameter and substantially in a columnar shape according to the Siemens method, thereby obtaining lumps of polycrystalline silicon.

Figure 1:
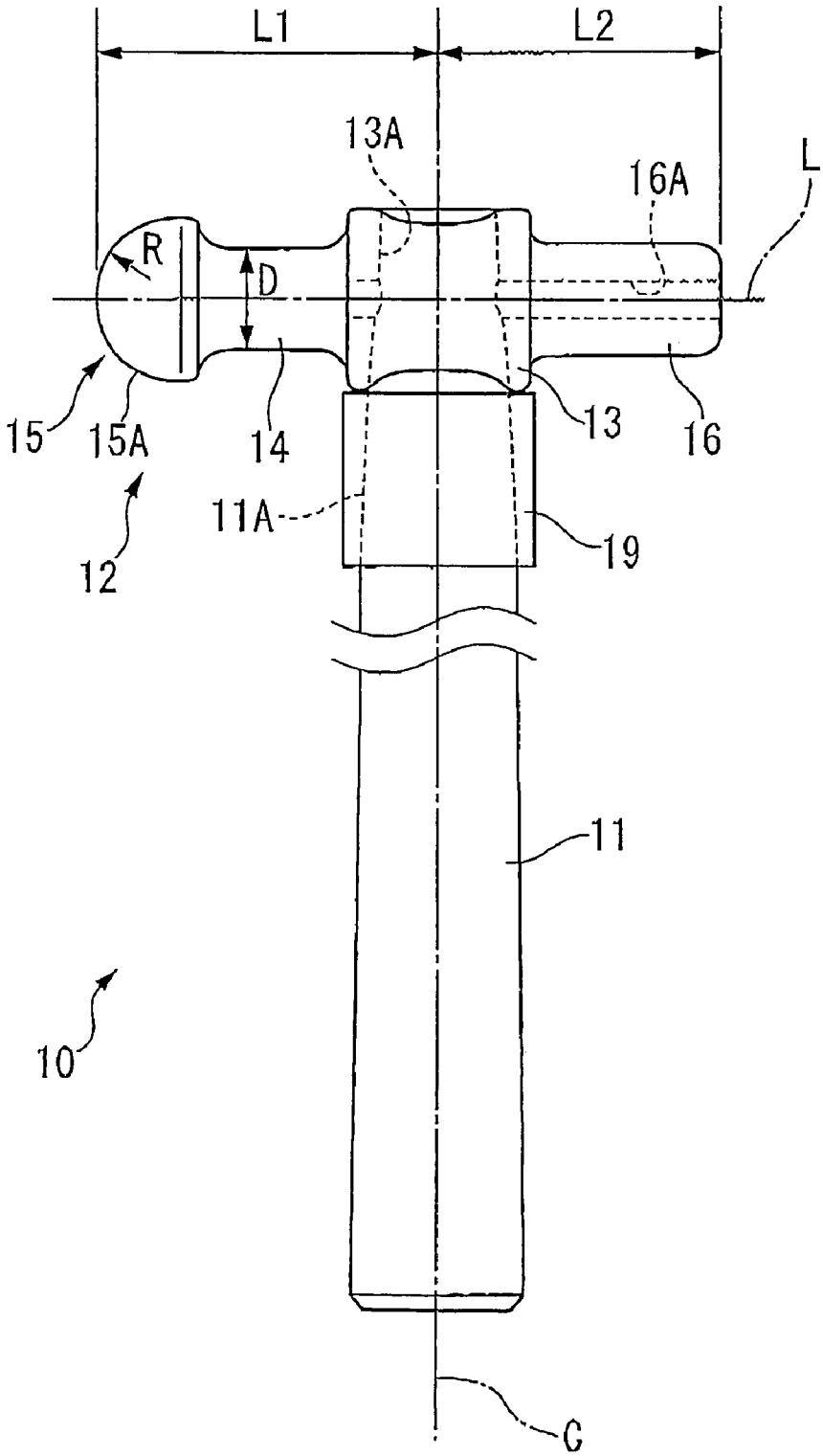
FIG. 1 is a side view showing a first embodiment of the hammer of the present invention for breaking polycrystalline silicon.
Figure 2:
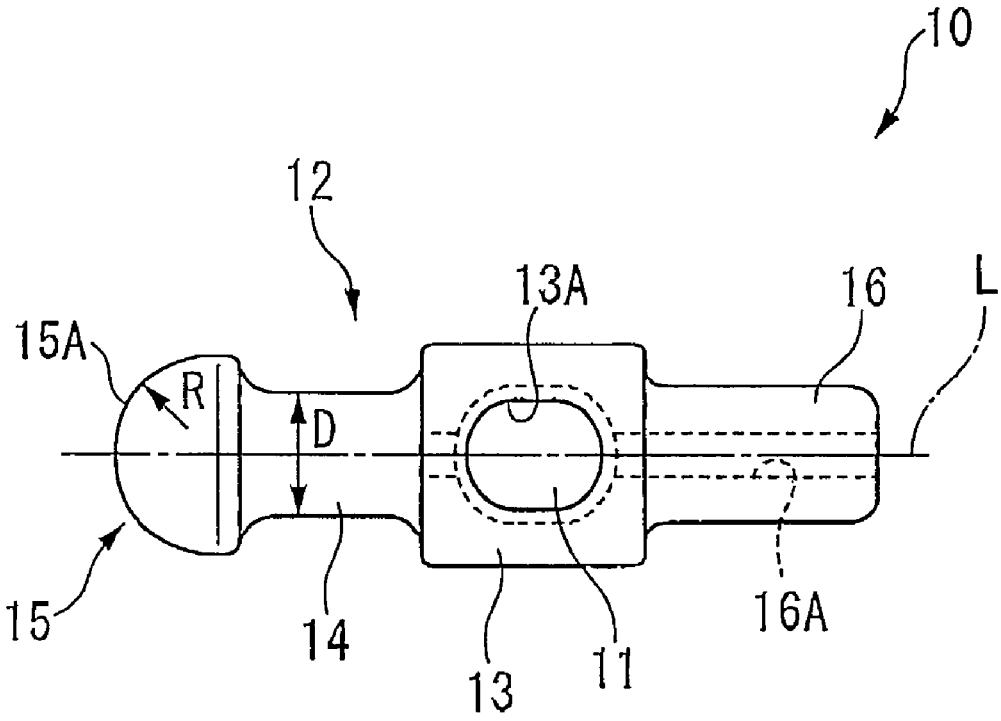
FIG. 2 is a plan view showing the first embodiment of the hammer of the present invention for breaking polycrystalline silicon.

As shown in FIG. 1 and FIG. 2, the hammer 10 is provided with a handle portion 11 formed in a straight rod shape and a head portion 12 extending along an axis line L in a direction intersecting the center axis C of the handle portion 11 (the lateral direction in FIG. 1) at the leading end of the handle portion 11 (the upper end in FIG. 1) In the present embodiment, the head portion 12 extends in a direction orthogonal to the center axis C. In other words, the center axis C is orthogonal to the axis line L.

The handle portion 11 is made of wood, and the cross section of the handle portion 11 orthogonal to the center axis C is formed substantially in an ellipsoidal shape. As shown in FIG. 1, the handle portion 11 is formed in such a manner that the longitudinal diameter of the cross section formed in an ellipsoidal shape is made gradually smaller as close to the leading end of the handle portion 11. Further, the leading end portion 11A of the handle portion 11 is formed in a tapered shape in such a manner that the longitudinal diameter and the short diameter of the cross section formed in an ellipsoidal shape are made gradually smaller as close to the leading end of the handle portion 11. The leading end portion 11A of the handle portion 11 is about 4° in a tapered angle. A synthetic-resin protective sleeve 19 is fitted at the outside of the handle portion 11.

The head portion 12 is provided with a head main body 13 connecting with the handle portion 11, a striking part 15 installed at one end of the head main body 13 (the left side in FIG. 1 and FIG. 2) via the coupling shaft portion 14, and a counter weight portion 16 disposed at the other end of the head main body 13 (the right side in FIG. 1 and FIG. 2). The head main body 13, the coupling shaft portion 14, the striking part 15 and the counter weight portion 16 are formed integrally from a hard metal mainly composed of tungsten carbide.

The head main body 13 is formed in a cylindrical shape extending along the axis line L of the head portion 12 in such a manner that an attaching hole 13A capable of inserting the leading end portion 11A of the handle portion 11 is made orthogonal to the axis line L. The attaching hole 13A is formed so as to trace the tapered shape of the leading end portion 11A of the handle portion 11, and the opening area of one opening portion (the upper opening portion in FIG. 1) is smaller than that of the other opening portion (the lower opening portion in FIG. 1).

The counter weight portion 16 is formed substantially in a columnar shape extending in a coaxial direction with the head main body 13, and the diameter of the counter weight portion 16 is smaller than that of the head main body 13. The external face of the head main body 13 smoothly-communicates with that of the counter weight portion 16 via a round recessed surface. Further, the end face of the counter weight portion 16 smoothly-communicates with the peripheral face thereof via a round raised surface. Still further, a stopper hole 16A extending along the axis line L is opened on the end face of the counter weight portion 16. The stopper hole 16A is formed so as to pass from the end face of the counter weight portion 16 to one end of the head main body 13.

The coupling shaft portion 14 is formed substantially in a columnar shape extending in a coaxial direction (axis line L) with the head main body 13, and the diameter of the coupling shaft portion 14 is smaller than that of the head main body 13. In the present embodiment, the diameter of the coupling shaft portion 14 is equal to that of the counter weight portion 16, and the external face of the coupling shaft portion 14 smoothly-communicates with that of the head main body 13 via a round recessed surface.

A semi-spherical striking part 15 is disposed at the coupling shaft portion 14. A semi-spherical striking surface 15A is formed at the striking part 15. In this case, the curvature radius R of the striking surface 15A may be in the range of 5 mm to 30 mm. In the present embodiment, the curvature radius R is 11 mm.

Further, the diameter D of the coupling shaft portion 14 is smaller than the diameter (that is 2·R) of the striking surface 15A. In this case, the diameter D of the coupling shaft portion 14 may be in the range from 0.6·R to less than 2·R. In the present embodiment, the diameter D of the coupling shaft portion 14 is 1.28·R. The external face of the coupling shaft portion 14 smoothly-communicates with that of the striking part 15 via a round recessed surface.

Substantially half of the leading end portion 11A of the handle portion 11, which is closer to the leading end of the handle portion 11, is fitted into the attaching hole 13A formed on the head main body 13, by which the handle portion 11 is connected with the head portion 12. The protective sleeve 19 covers substantially half of the leading end portion 11A of the handle portion 11, which is closer to the base end of the handle portion 11. In this case, when the distance from the center axis C of the handle portion 11 to the top of the head of the striking surface 15A is given as L1 and the distance from the center axis. C to the end face of the counter weight portion 16 is given as L2, a ratio of L1 to L2 may be in the range of 1 to 2. In the present embodiment, the ratio of L1 to L2 is 1.22.

In the hammer 10 of the present embodiment, the striking surface 15A of the hammer 10 of the present embodiment strikes an ingot of polycrystalline silicon which is substantially in a columnar shape, and thereby the ingot of polycrystalline silicon is broken to obtain lumps of polycrystalline silicon which are called chunks.

According to the hammer 10 of the present embodiment, since the head portion 12 having the head main body 13, the coupling shaft portion 14, the striking part 15 and the counter weight portion 16 is formed integrally from a hard metal, the head portion 12 does not chip upon impact when striking, thus making it possible to prevent the generation of metal powder. As a result, it is possible to prevent impurities from being mixed into broken pieces of polycrystalline silicon.

Further, since the striking part 15 is provided with the semi-spherical striking surface 15A, the striking surface 15A is in contact with the ingot in a smaller contact area, when striking an ingot of polycrystalline silicon. Therefore, the polycrystalline silicon is broken into pieces of suitable size, thus making it possible to prevent the generation of silicon powder. Still further, since the semi-spherical striking surface 15A is formed round at the periphery without having an edge, the head portion 12 does not chip on impact of striking. As a result, it is possible to prevent the metal powder for being generated.

Further, since the diameter D of the coupling shaft portion 14 is smaller than the diameter of the semi-spherical striking surface 15A, the center of gravity of the hammer 10 is arranged so as to be closer to the striking part 15 than the head main body 13. Thereby, a greater striking force can be obtained with a smaller force, making it possible to break polycrystalline silicon efficiently.

Since the handle portion 11 is made of wood, the hammer 10 is lighter and handled more easily. Further, since the synthetic-resin protective sleeve 19 is fitted at the outside of the handle portion 11, the wood is not broken on collision of polycrystalline silicon with the handle portion. Therefore, it is possible to prevent wood chips from being mixed into broken pieces of polycrystalline silicon.

Still further, since the ratio of L1 to L2 is in the range of 1 to 2 (the ratio of L1 to L2 is equal to 1.22 in the present embodiment), the center of gravity of the hammer 10 is arranged so as to be closer to the striking part 15 than the head main body 13. Thereby, a greater striking force can be obtained with a smaller force. Since an appropriate distance is retained between the center axis C of the handle portion 11 to the top of the head of the striking surface 15A, an operator is not in danger of pounding his/her hand gripping the handle portion 11 against the polycrystalline silicon. Therefore, it is possible to break the polycrystalline silicon easily.

In the present embodiment, regarding the head portion 12, each of a part between the striking part 15 and the coupling shaft portion 14, a part between with the head main body 13 and the coupling shaft portion 14, and a part between the head main body 13 and the coupling shaft portion 14 is formed in the round recessed surface, and the end surface of the counter weight portion 16 smoothly-communicates with the peripheral face thereof via a round raised surface. Therefore, it is possible to prevent the head portion 12 from chipping.

EXAMPLE

Observation results of which the condition of pieces of polycrystalline silicon depending on the size of curvature radius R of the striking surface 15A are shown in the following table.

Ingots of polycrystalline silicon of which the diameter was 130 mm were broken into lumps, the maximum lengths of which were in the range of 5 mm to 120 mm, by using a plurality of hammers having different striking surface curvature radiuses, and this operation was conducted for six hours every day for 20 days. At the end of the 20 days, broken pieces, a maximum length of which was 5 mm or less, were referred to as silicon loss. For each of the hammers used, the quantity of silicon loss and the total production quantity (a quantity of lumps in desired-size) were recorded and observations were made for the striking surface of a hammer and therearound.

| CURVATURE RADIUS (R) | 3 | 7 | 11 | 17 | 27 | 45 | FLAT |
|---|---|---|---|---|---|---|---|
| SILICON LOSS | 8.2 | 4.8 | 4.1 | 5.2 | 5.6 | 10.3 | 12.4 |
| PRODUCTION QUANTITY | 93 | 98 | 100 | 103 | 105 | 104 | 102 |
| VICINITY OF STRIKING SURFACE | FREE OF CHIPPING | FREE OF CHIPPING | FREE OF CHIPPING | FREE OF CHIPPING | FREE OF CHIPPING | FREE OF CHIPPING | CHIPPING |

In the above table, the curvature radius is measured in millimeters. When a basic production quantity by the striking surface of which the curvature radius is R=11 is set to 100, the production quantity of each of the cases is indicated as the quantity being comparative to the reference production quantity.

Further, the quantity of silicon loss is indicated by the following formula:

[{(weight of silicon before broken)−(weight of silicon after broken)}/(weight of silicon before broken)]·100 (%).

As apparent from the above table, when the striking surface of a hammer is flat, the striking surface may chip resulting in broken pieces of metal being mixed with the polycrystalline silicon. When the striking surface of the hammer is raised, no chipping of the striking surface occurs. However, when the curvature radius R is 3 mm, and when the curvature radius is 45 mm, a greater quantity of silicon loss occurs than in hammers with other curvature radii, even for a hammer whose striking surface is raised. This is because an excessively large curvature radius makes the striking surface substantially flat which smashes the silicon, thus resulting in an increased silicon loss. On the other hand, an excessively small curvature radius will allow the striking surface to project. When a hammer with the projected striking surface is used to strike an ingot, the energy is concentrated on the leading end of the striking surface which decreases the loss resulting from each strike. It is estimated, however, that the hammer is decreased in weight which lowers the breakage efficiency. As a result, the number of strikes increases for breaking the polycrystalline silicon resulting in an increased silicon loss. In addition, the production quantity is decreased.

From the above results, the curvature radius R of the striking surface 15A is preferably in the range of 5 mm to 30 mm, and the most preferable curvature radius R is 11 mm.

Second Embodiment

Figure 3:
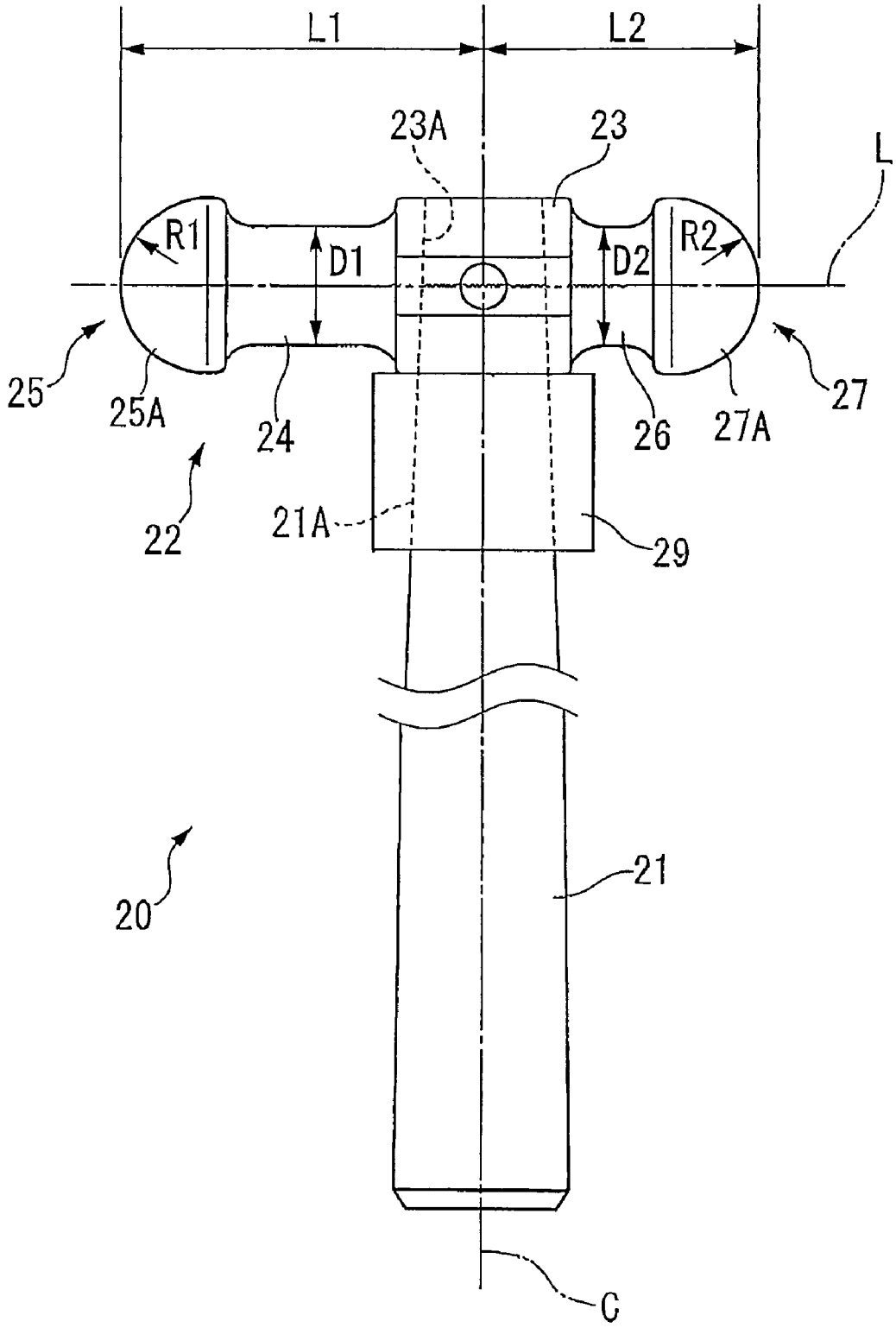
FIG. 3 is a side view showing a second embodiment of the hammer of the present invention for breaking polycrystalline silicon.
Figure 4:
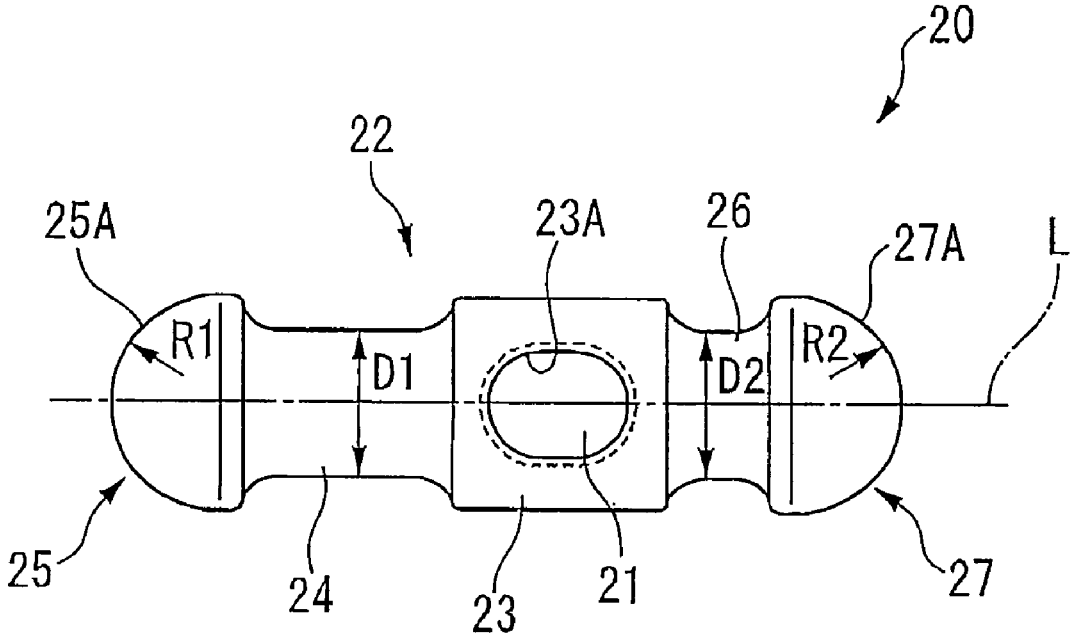
FIG. 4 is a plan view showing the second embodiment of the hammer of the present invention for breaking polycrystalline silicon.

As shown in FIG. 3 and FIG. 4, a hammer 20 of the present embodiment for breaking polycrystalline silicon is provided with a handle portion 21 formed in a straight rod shape and a head portion 22 extending in a direction intersecting the center axis C of the handle portion 21 (the lateral direction in FIG. 3) at the leading end of the handle portion 21 (the upper end in FIG. 3).

The handle portion 21 is made of wood, and the cross section of the handle portion 21 orthogonal to the center axis C is formed substantially in an ellipsoidal shape. As shown in FIG. 3, the handle portion 21 is formed in such a manner that the longitudinal diameter of the cross section formed in an ellipsoidal shape is made gradually smaller as close to the leading end of the handle portion 21. Further, a leading end portion 21A of the handle portion 21 is formed in a tapered shape in such a manner that the longitudinal diameter and the short diameter of the cross section formed in an ellipsoidal shape are made gradually smaller as close to the leading end of the handle portion 21. The leading end portion 21A of the handle portion 21 is about 2° in a tapered angle. A synthetic resin protective sleeve 29 is fitted at the outside of the handle portion 21.

The head portion 22 is provided with a head main body 23 connecting with the handle portion 21, a striking part 25 installed at one end of the head main body 23 (the left side in FIG. 3 and FIG. 4) via the coupling shaft portion 24 and a counter weight portion 26 disposed at the other end of the head main body 23 (the right side in FIG. 3 and FIG. 4).

In the present embodiment, a second striking part 27 and a second striking surface 27A are disposed at the counter weight portion 26. The head main body 23, the coupling shaft portion 24, the striking part 25, the counter weight portion 26 and the second striking part 27 are formed integrally from a hard metal mainly composed of tungsten carbide.

The striking part 25 is formed in a semi-spherical shape. A semi-spherical striking surface 25A is formed at the striking part 25. In this case, the curvature radius R1 of the striking surface 25A may be in the range of 5 mm to 30 mm. In the present embodiment, the curvature radius R1 is 17.5 mm.

Further, the diameter D1 of the coupling shaft portion 24 is smaller than the diameter (that is 2·R1) of the striking surface 25A. In this case, the diameter D1 of the coupling shaft portion 24 may be in the range of 0.6·R1 to less than 2·R1. In the present embodiment, the diameter D1 of the coupling shaft portion 24 is 1.38·R1.

The second striking part 27 disposed on the counter weight portion 26 is also formed in a semi-spherical shape. A second semi-spherical striking surface 27A is formed at the second striking part 27. In this case, the curvature radius R2 of the second striking surface 27A is in the range of 5 mm to 30 mm. In the present embodiment, the curvature radius R2 is 17.5 mm.

The diameter D2 of an intermediate part of the counter weight portion 26 is smaller than the diameter (that is 2·R2) of the second striking surface 27A. In this case, the diameter D2 of the counter weight portion 26 may be in the range of 0.6·R2 to less than 2·R2. In the present embodiment, the diameter of the counter weight portion 26 is 1.38·R2.

Substantially half of the leading end portion 21A of the handle portion 21 closer to the leading end of the handle portion 21 than the base end thereof is fitted into the attaching hole 23A formed on the head main body 23, by which the handle portion 21 is connected with the head portion 22. The protective sleeve 29 is covered on substantially half of the leading end portion 21A of the handle portion 21 closer to the base end of the handle portion 21 than the leading end thereof. In this case, when the distance from the center axis C of the handle portion 21 to the top of the head of the striking surface 25A is given as L1 and the distance from the center axis C to the top of the head of the second striking surface 27A disposed at the counter weight portion 26 is given as L2, the ratio of L1 to L2 may be in the range of 1 to 2. In the present embodiment, the ratio of L1 to L2 is 1.32.

According to the hammer 20 of the present embodiment, since the second striking surface 27A is formed at the counter weight portion 26, it is possible to strike polycrystalline silicon not only by the striking surface 25A of the striking part 25 but also by the second striking surface 27A. Thereby, it is possible to selectively use two striking surfaces 25A and 27A, depending on the shape of an ingot to be broken and the size of lumps to be obtained, thus making it possible to break polycrystalline silicon efficiently. For example, when it is desired to provide a large impact to the ingot, the striking surface 25A which is located away from the center axis C of the handle portion 21 is preferably used to strike. When it is desired to accurately strike a spot to give an impact, the second striking surface 27A closer to the center axis C of the handle portion 21 than striking surface 25A is preferably used to strike.

A description has been given of several embodiments related to the hammer of the present invention for breaking polycrystalline silicon, to which the present invention shall not be limited, and may be modified in any appropriate manner within the scope and not departing from a technical idea of the invention.

In the above embodiment, the handle portion is made of wood. However, the handle portion may be made of a different material such as plastic. Further, a connecting pin may be used to connect the handle portion with the head portion.

Further, in the above embodiment, the longitudinal direction of the handle portion is orthogonal to a direction in which the head portion extends. However, the longitudinal direction of the handle portion may obliquely intersect a direction in which the head portion extends.

Still further, in the above embodiment, the striking part is provided with the semi-spherical striking surface. However, the striking part may be provided with the raised surface.

What is claimed is:

1. A hammer for breaking polycrystalline silicon comprising:

a rod-shaped handle portion; and a head portion extending in a direction intersecting a center axis of the handle portion at a leading end of the handle portion, wherein the head portion is provided with a head main body connecting with the handle portion, a striking part installed at one end of the head main body via a coupling shaft portion, and a counter weight portion installed at the other end of the head main body, the head main body, the coupling shaft portion, the striking part and the counter weight portion are formed integrally, and a first striking surface is formed at the striking part, the striking part is formed in a half-spherical shape, a second striking surface is formed at the counter weight portion wherein the second striking surface is formed in a half-spherical shape, a curvature radius R of the first striking surface and the second striking surface is the range of 5 mm to 30 mm, and a distance from the center axis of the handle portion to the first striking surface is farther than a distance from the center axis to the second striking surface.

2. The hammer for breaking polycrystalline silicon according to claim 1, wherein the diameter of the coupling shaft portion is smaller than that of the half-spherical striking part.

3. The hammer for breaking polycrystalline silicon according to claim 1, wherein when a distance from the center axis of the handle portion to the top of the head of the first striking surface is given as L1 and a distance from the center axis to the second striking surface of the counter weight portion is given as L2, the ratio of L1 to L2 is larger than 1 and not more than 2.

4. The hammer for breaking polycrystalline silicon according to claim 1, wherein the handle portion is made of wood and a synthetic resin protective sleeve is fitted at the outside of the handle portion.

5. The hammer for breaking polycrystalline silicon according to claim 1, wherein the head portion is made of a material composed of tungsten carbide.

6. A hammer for breaking polycrystalline silicon comprising;

a rod-shaped handle portion; and a head portion extending in a direction intersecting a center axis of the handle portion at a leading end of the handle portion, wherein the head portion is provided with a head main body connecting with the handle portion, a striking part installed at one end of the head main body via a coupling shaft portion, and a counter weight portion installed at the other end of the head main body, a first striking surface is formed at the striking part, a second striking surface is formed at the counter weight portion, each of the first and second striking surfaces is formed in a half-spherical shape, and a distance from the center axis of the handle portion to the first striking surface is farther than a distance from the center axis to the second striking surface.

* * * * *